United States Patent [19]

Bond et al.

[11] 4,015,526

[45] Apr. 5, 1977

[54] EXPLOSIVE CHARGE

[75] Inventors: John Alan Bond, Stevenston; George Martin Frazer Cheyne, Troon, both of Scotland; Adrien Patrick Rayner, Iver, England

[73] Assignee: Imperial Chemical Industries Limited, London, England

[22] Filed: Apr. 4, 1975

[21] Appl. No.: 565,136

[30] Foreign Application Priority Data

Apr. 10, 1974 United Kingdom ..... 15803/74
July 25, 1974 United Kingdom ..... 32872/74

[52] U.S. Cl. ..... 102/21.6; 102/24 R; 181/118

[51] Int. Cl.[2] ..... E21B 43/26

[58] Field of Search ..... 102/24 R, 21.6; 181/118

[56] References Cited

UNITED STATES PATENTS

| | | | |
|---|---|---|---|
| 2,366,067 | 12/1944 | Smith | 102/24 R |
| 2,755,735 | 7/1956 | Harter, Jr. | 102/24 R |
| 2,887,953 | 5/1959 | Mager | 102/24 R |
| 3,013,492 | 12/1961 | Sexton | 102/24 R |
| 3,150,590 | 9/1964 | Silverman | 102/21.6 |
| 3,195,928 | 7/1965 | Pasternack | 102/24 R |
| 3,326,126 | 6/1967 | Berthmann et al. | 102/24 R |
| 3,376,816 | 4/1968 | Foster et al. | 102/24 R |

*Primary Examiner*—Brooks H. Hunt
*Attorney, Agent, or Firm*—Cushman, Darby & Cushman

[57] ABSTRACT

An explosive charge for use under hydrostatic pressure comprising high explosive composition in a flexible plastics container closed at one end and having, at the mouth end, a shoulder and a neck defining the container opening, the opening being sealed by a closure cap which provides a central plug to support the neck against internal distortion and an outer annular skirt which supports the neck and shoulder against external distortion.

19 Claims, 10 Drawing Figures

EXPLOSIVE CHARGE

This invention relates to a new and improved container for an explosive charge for blasting or generating seismic waves under conditions of substantial hydrostatic pressure and to the said explosive charge.

A commonly used explosive charge for underwater blasting and for use in deep water stemmed drillholes in seismic prospecting operations comprises hardened powdered explosive contained in a thin-walled cylindrical sheet metal canister. The powdered explosive generally contains a high proportion of ammonium nitrate and a little water and is usually hardened by heating the charge to a temperature above 32.3° C, the transition point of ammonium nitrate IV to ammonium nitrate III, and cooling. The hardened composition provides internal support to the canister wall and prevents excessive distortion of the canister and the consequent leakage of water into the composition, which would otherwise occur at the canister seams when the charge is used under high water pressure. The production of such explosive charges is described in United Kingdom Pat. Nos. 776,185 and 942,345.

Sheet metal canisters have many obvious disadvantages as containers for charges for underwater use and the design of a suitable canister represents a compromise between technical efficiency and cost. Although the measures proposed in the aforementioned UK patents reduced detonation failures under the hydrostatic pressures encountered in seismic prospecting to an acceptable level, some failures inevitably occur and the failure rate increases on prolonged storage of the charges due to corrosion of the metal by the corrosive constituents of the composition and the environment.

An obvious remedy to the corrosion problem is to use a container material such as ceramic or plastics which is resistant to chemical attack. However, ceramics are too brittle for use in seismic prospecting and, whilst not eliminating the risk of leakage, would introduce even more dangerous hazards. Rigid plastics would also be liable to crack in use unless used in thicknesses which would be excessively expensive. The only practical form of plastics material is flexible plastics material, but hitherto no flexible plastics container has been generally adopted probably because of the difficulty of designing a container closure which can be applied after the container is filled with explosive and will remain sealed when the filled container is subjected to substantial hydrostatic pressure.

It is an object of this invention to provide a flexible plastics container for an explosive charge suitable for use under substantial hydrostatic pressure. Flexible in this context means capable of flexing without cracking under the pressures at which the explosive charge is designed to be used.

It is a further object to provide such explosive charges for seismic prospecting wherein the explosive is encased in a flexible plastics container.

In accordance with the invention a flexible plastics container for an explosive charge for use under substantial hydrostatic pressure comprises a body having a closed end portion, a shoulder portion and a neck portion defining the container opening, and a closure cap for sealing the container opening, said cap having a circular end wall portion adapted to engage the end of said neck portion transversely to provide a leakproof seal and, depending from said circular end wall portion, a continuous central plug adapted to fit into the container opening and support the neck portion against internal distortion and an outer annular skirt adapted to fit around the outside of the neck portion and against the shoulder to support the neck and shoulder against external distortion, the plug and skirt defining an annular recess adapted to receive the neck portion, and the closure cap and container body having engagement means to retain the closure cap and body in sealing engagement.

Preferably the container shoulder is stepped or recessed and the bottom portion of the skirt is accommodated in the shoulder step, whereby the closure outside diameter may be equal to or less than the outside diameter of the container body.

The means to engage the closure cap and the container body could conveniently be a snap-on engagement such as a bead and groove engagement but a screw engagement is preferred. In a preferred container, locking means are included to prevent unscrewing of the cap, suitable locking means comprising ratchet interengagement means. It is also advantageous to include an annular sealing ring of resilient material such as rubber in the said annular recess of the closure cap to provide the seal between the cap end wall portion and the neck.

Preferred explosive charges are provided with means to connect the charges in end-to-end contact to facilitate the assembly of a long file of charges. Thus, the closed end of the container may be provided with a threaded portion and the closure cap provided with a mating threaded portion whereby the closed end of one container may be screwed to the closure cap of another container. For such screw engagement it is preferable to form an internally threaded external recess in the circular end wall portion and the plug portion of the closure cap and an externally threaded axially projecting tubular portion on the closed end of the container body.

The closure cap may also if desired be modified by the provision of an internally projecting pocket adapted to accommodate a detonator (blasting cap).

The container may conveniently be made from any flexible plastics material, for example polyethylene, polypropylene or polyvinyl chloride as are generally used for the so-called squeeze bottles.

The explosive charge of the invention comprises high explosive composition encased in a flexible container in accordance with the invention.

The high explosive composition may be any solid or liquid explosive but a powdered composition is especially suitable. The preferred composition is an ammonium nitrate powder explosive and advantageously the composition is at least partially hardened as described in United Kingdom Pat. Specification No. 776,185.

Further features and aspects of the invention will become apparent from the following description, given by way of example and with reference to the accompanying drawings, of a charge embodying the invention. In the drawings.

Figure 1:
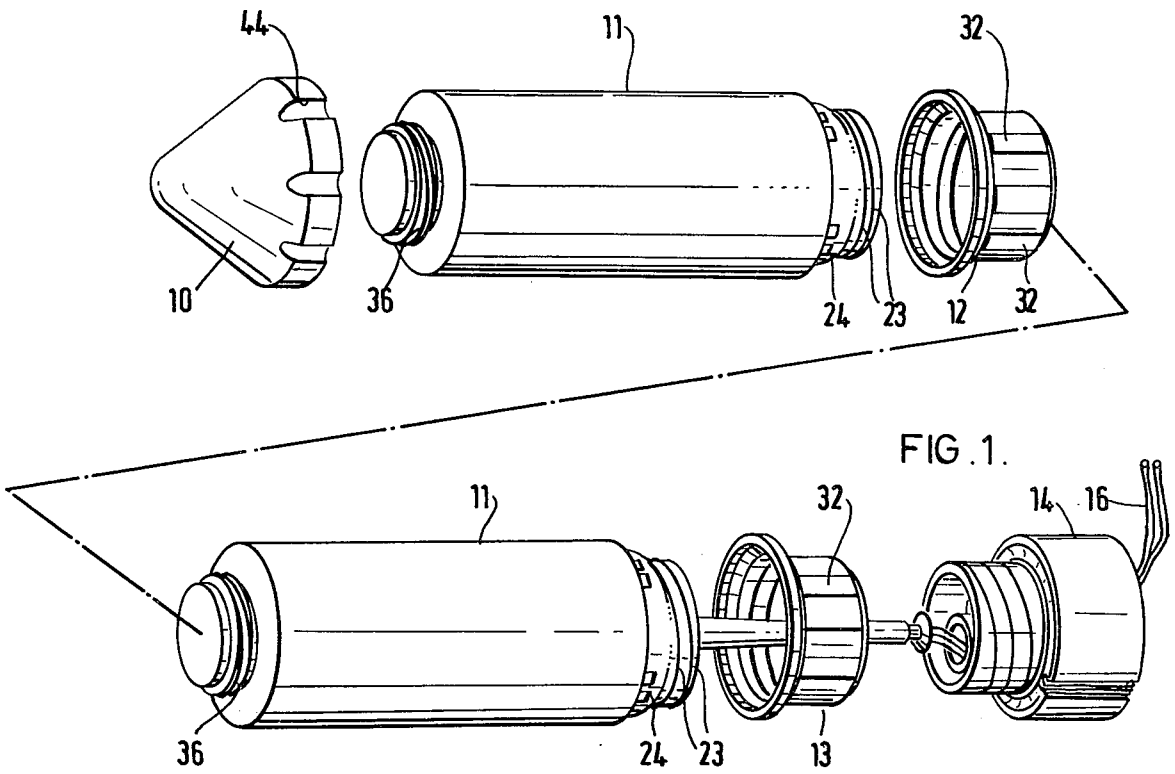
FIG. 1 is a diagrammatical exploded perspective view of an assembly for seismic prospecting incorporating explosive charges of the invention.

Referring now to FIG. 1 of the drawings, the assembly for seismic exploration is made up of six different basic parts arranged in a series string. The six parts are a nose piece 10, a charge container body 11, a container closure cap 12, a modified closure cap 13 provided with a detonator pocket, a detonator holder 14, and a detonator 15. The detonator is conventional, being of elongate cylindrical form and having two detonating wires 16 attached to it at its right hand end as shown.

Only one of each of the items 10, 13, 14 and 15 is included in the series string. The number of charge containers 11 is determined by the size of the total amount of explosive required; thus, as many as seven containers are generally used. The charge containers 11 are joined end-to-end through the closure caps 12. The containers 11 are filled with high explosive composition, an end container having a modified closure cap 13 containing a 'primer' charge of an explosive composition sufficiently sensitive to be initiated by a commercial detonator and the remaining containers being filled with 'maincharge' composition which is insensitive to initiation by a detonator but capable of being initiated by the primer charge of the assembly. For clarity, only two containers, one containing 'primer' composition and the other maincharge' composition, are shown in FIG. 1.

Figure 2:
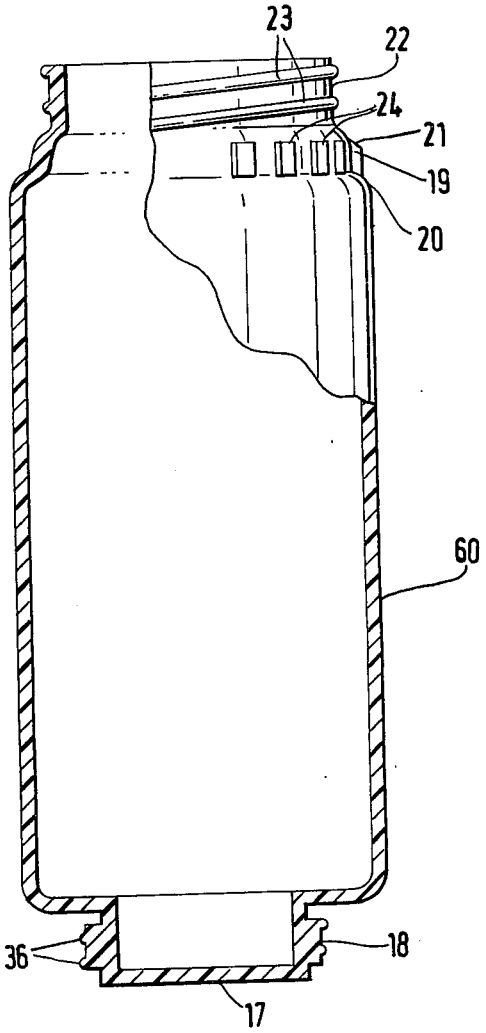
FIG. 2 shows the body of a charge container forming part of an explosive charge of FIG. 1, partly in vertical cross-section.
Figure 3:
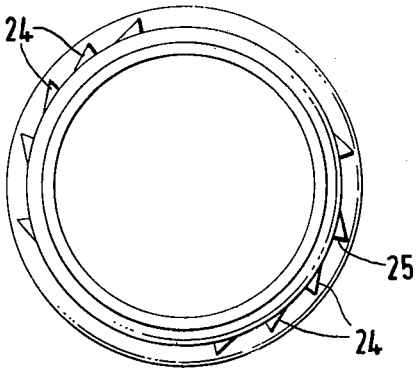
FIG. 3 is an elevation of the left hand end of the charge container as seen in FIG. 2.
Figure 4:
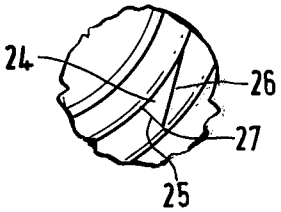
FIG. 4 is an enlargement of the ringed part of FIG. 3.

The arrangement of the individual items 10 to 14 will be apparent from FIGS. 2 to 10 of the drawings, with reference to which the ensuing description is to be given. Referring now to FIGS. 2 to 4, each container has a generally cylindrical hollow body 11 blow-moulded from high density polyethylene having a central hollow cylindrical portion 60. The body is closed at one end by the end wall 17 of an externally screw-threaded cylindrical portion 18 of substantially smaller diameter than the central portion 60. The screw-threads of the portion 18 are indicated in the drawings by the reference numeral 36.

Adjacent to the central portion 60 at the other end of the container body 11 is a further, basically cylindrical short shoulder step portion 19 of somewhat smaller diameter than the central portion 60. This portion 19 merges with the portion 60 at a shoulder portion 20 at one of its ends. At its other end it merges at a further shoulder portion 21 with a neck portion 22 which is cylindrical and has a diameter smaller than that of the portion 19 but larger than that of the portion 18 at the opposite end of the charge holder. The portion 22 is externally screw-threaded at screw-threads 23.

Ten identical ratchet stops 24 are integrally formed on the portion 19. As can be seen in FIG. 4 which shows the ringed part of FIG. 3 in enlarged view, each stop comprises a stop face 25 lying on a radially extending axial plane of the holder 11, and an inclined ramp face 26. The faces 25, 26 are joined along a crest 27, the crests of all the stops being located on a cylindrical envelope.

The stops 24 (FIG. 3) are grouped as two individual stops located on a diameter of the body 11, and two groups of four successive stops which are also diametrically disposed in pairs. The four stops of each group of four have a relative pitch of 18°; the two individual stops are each pitched by 27° in relation to the rearmost stop of the adjacent group in the screwing-up sense of the screw-threads 23. This particular arrangement of the stops 24 is advantageous in view of the requirement to separate the halves of the blow-mould used for the manufacture of the carrier 11. The separation line of the mould halves corresponds to the vertical diameter of the carrier as depicted in FIG. 3.

Figure 5:
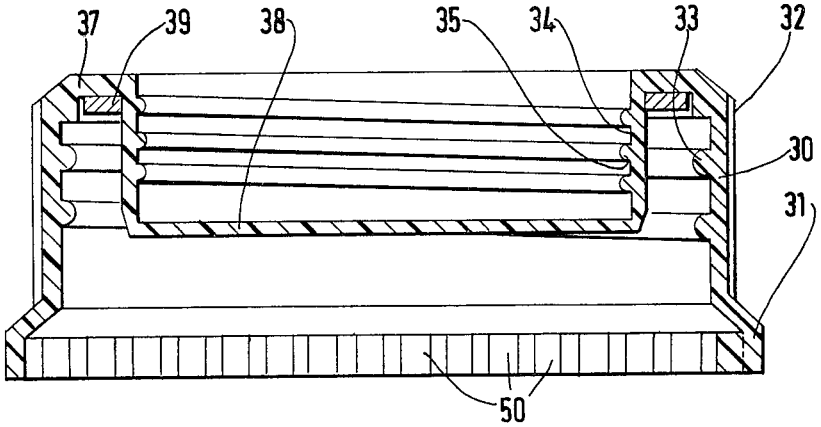
FIG. 5 shows in vertical cross-section a closure cap of an explosive charge of FIG. 1.
Figure 6:
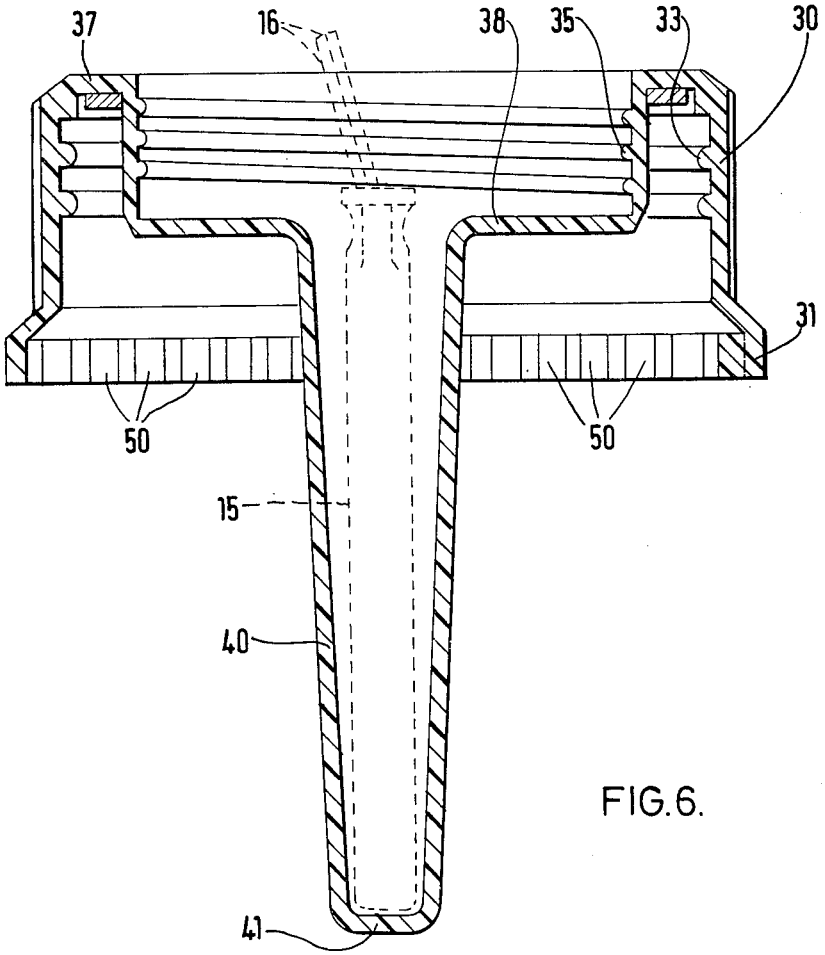
FIG. 6 is a similar view of a modified closure cap of an explosive charge of FIG. 1 provided with a pocket for the accommodation of a detonator.
Figure 7:
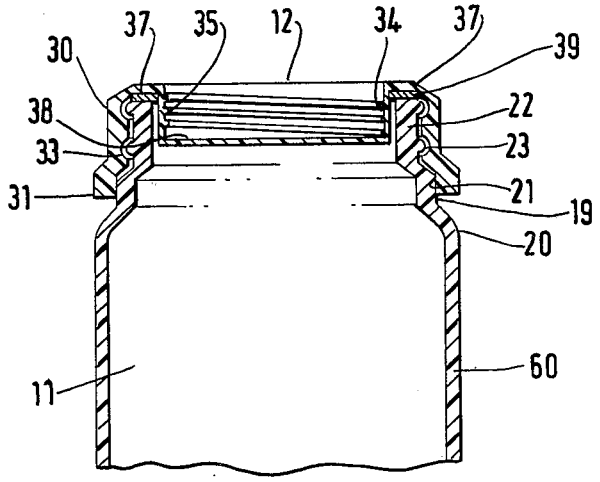
FIG. 7 shows an end of a charge container of FIG. 1 in vertical cross-section closed with the closure cap of FIG. 5.
Figure 8:
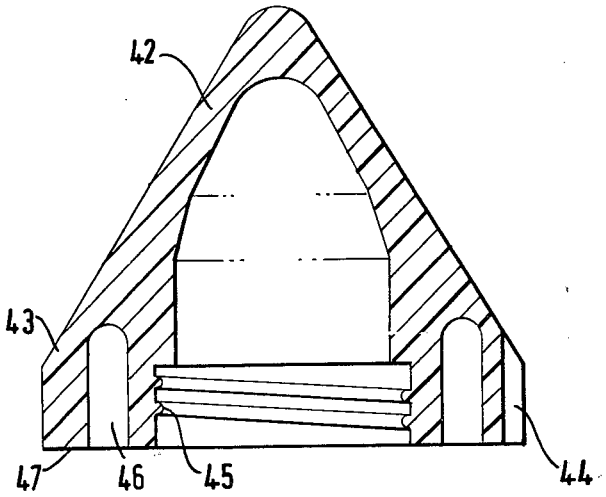
FIG. 8 shows the nose piece of the assembly of FIG. 1 in vertical cross-section.

Referring now to FIG. 5 the closure cap 12 is injection moulded from high density polyethylene. It comprises an annular wall portion 37 from the external periphery of which depends an external skirt portion formed by two generally cylindrical connection portions 30,31 the portion 30 of which is substantially longer than the portion 31 but of slightly smaller diameter. This longer portion 30 is externally formed with raised lands 32 for assisting manipulation as is later to be described. On its interior surface it is formed with a screw-thread 33 arranged for cooperation with the screw-thread 23 of a container body 11.

The portion 31 is internally formed with forty identical and regularly spaced ratchet stops 50 arranged for cooperation with the stops 24 of a container body 11 engaging the threads 33. The stops 50 are similar in form to the stops 24 and are therefore not described.

Also dependent from the annular wall portion 37 of the closure cap 12 is cylindrical plug portion 34 having a substantially smaller external diameter than the internal diameter of the portion 30. The portion 34, which is shorter in length than the portion 30, is arranged concentrically within the portions 30,31 and has its internal cylindrical surface formed with a screw-thread 35 for engagement with the previously described screw-thread 36 of a container body 11. The portion 34 has one end transversely aligned with the free end of the portion 30 and connected thereto by the transverse annular wall 37. The other end of the portion 34 lies within the confines of the portion 30 and is closed by a transverse circular wall 38. It will therefore be seen that the portions 30,34 and the wall 37 together form an annular recess in which the neck portion 22 of the container body 11 is accommodated (as in FIG. 7). Within this recess, adjacent the wall 37, there is located an annular sealing ring 39 of rubber or other elastomeric material for engagement with the end of the neck portion 22.

The closure cap 13 (FIG. 6) is identical to the closure cap 12 except in respect of its wall 38. Instead of being plane, the wall 38 is formed with an elongate detonator-receiving axial pocket 40 which extends axially of the connection piece beyond the portion 31. The pocket 40 tapers slightly towards its free end 41, which is closed. The pocket 40 is internally dimensioned to receive the detonator 15 (shown in ghosted outline) inserted through the open other end of the pocket 40 at the wall 38.

The nose piece 10 (FIG. 8) is hollow and injection moulded from high density polypropylene. It comprises a conical front portion 42 having a rounded apex, and a short cylindrical portion 43, with which the portion 42 merges at its other end. Longitudinal grooves 44 are regularly formed around the portion 43 to assist gripping. In addition, the interior of the nose piece is formed with screw threads 45 for cooperation with the screw threads 36 of a container body 11. An annular recess 46 is formed in the transverse end wall 47 of the nose piece for economy and weight reduction.

Figure 9:
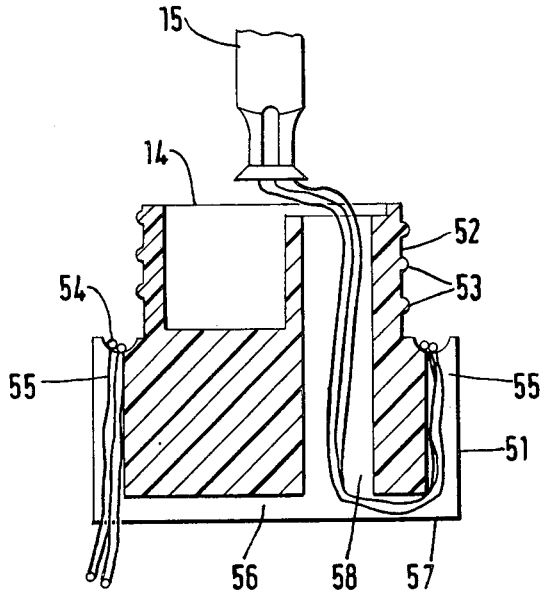
FIG. 9 shows in vertical cross-section a holder for the charge detonator for the assembly of FIG. 1 with the detonator attached.
Figure 10:
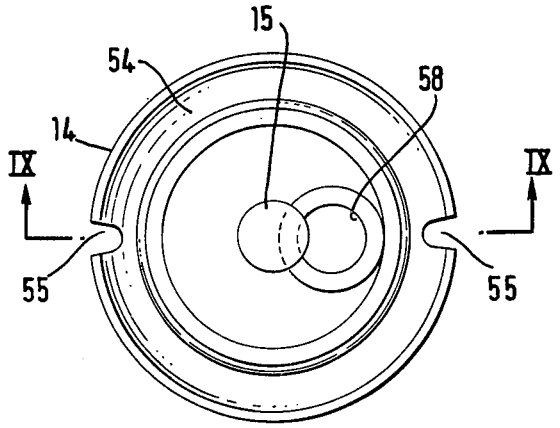
FIG. 10 is an elevation of the left hand end of the detonator holder and detonator as seen in FIG. 9.

The shape and arrangement of the detonator holder 14 and the manner in which the detonator 15 is attached to it can be seen from FIGS. 9 and 10. Referring now to those Figures, the detonator holder is formed from a thermosetting resin material such as is sold under the Trade Mark Bakelite. It has a smooth cylindrical portion 51 having approximately the same diameter as the overall diameters of the previously described items 10 to 13, and a reduced diameter portion 52 which projects axially from one end of the portion 51 and is formed with an external screw-thread 53 to engage the screw-thread 35 of a closure cap 13.

The annular transverse face joining the portions 51,52 is formed around its length with a recess 54 of semi-circular section. Diametrically opposed axially extending recesses 55 in the portion 51 periphery communicate this recess 54 with a further recess 56 formed on a diameter of the holder 14 at the free end face 57 of the portion 51.

An aperture 58 extends axially through the holder 14 from the face 57 to stop just short of the opposite free end of the holder 14. This aperture is centred on the recess 56 so as to be in communication with that recess, but is off-set radially from the longitudinal axis of the holder 14.

In use of the items described, container bodies 11 in number appropriate to the test being conducted are filled with explosive and are each closed by screwing a closure cap 12 or 13 onto their neck portions 22 (as in FIG. 7), the cap 13 being used for closing the single end charge filled with a priming composition and the one or more caps 12 being used for individually closing the one or more charges filled with main charge composition.

Each closure 12 or 13 is screwed onto its associated container body 11 in the normal way. Towards the end of this operation, when the closure cap is approaching its fully screwed-up position, the ratchet stops 50 of the closure cap come into engagement with the similar stops 24 on the respective container body. The sense of the inclined surfaces of the stops is such that the stops ride over one another, the accompanying relative radial movement of the closure cap and the container body being largely accommodated by radial expansion and contraction of the body. When, finally, the closure cap is screwed fully home the stop faces of the stops on the two members engage one another to prevent the cap from being unscrewed, either inadvertently or otherwise. It will be appreciated that the spacing of the stops on the body 11 and on the closure cap is such that the engagement of all the pairs of cooperating stops occurs simultaneously so that the maximum resistance is provided against unscrewing of the closure cap.

In the closure container the skirt portion 30, 31 of the closure cap is in tight circumferential engagement with the cylindrical portion 19 and rests firmly on the shoulder portion 21 of the container body 11, and the plug portion 34 is closely fitting within the body neck portion 22. The body neck is thereby supported against distortion.

The filled containers 11 closed with the closure caps 12, 13 attached are conveniently sized explosive charges for transport. Preferably, therefore, they are filled and closed in a suitably protected environment, and are then transported to site for assembly.

To form the assembly for seismic prospecting (as shown in FIG. 1) the explosive charges are screwed together by their screw-threads 36 engaging the screw-threads 35 in the closure caps 12. The nose piece 10 is screwed onto the screw-thread 36 of the foremost charge holder, and the detonator holder 14 with the detonator 15 wired to it is screwed onto the screw-thread 35 of the closure cap 13 of the 'primer' charge, the detonator being received in the pocket 40 of closure cap 13. The charge is then ready for use.

It will be appreciated that, although preferable, the particular order of assembly described above is not essential. For example, the assembly can be built up in a serial manner on site, starting at the nose piece 10 and then working vertically upward along the string; the explosive charges being added in succession.

Although particular materials and processes of manufacture described for the various items of the described explosive charge are preferred, they are in no way essential; other materials and/or processes may be used.

The practice of the invention is further illustrated with reference to the following Example.

EXAMPLE

Primer and maincharge explosive charges are described and shown in the accompanying drawings were assembled using high density polyethylene bodies 6 cm diameter × 15.6 cm long and 1.3 mm thick. The composition of the primer charge contained (by weight) 80 parts ammonium nitrate (normal explosive grade) 20 parts trinitrotoluene and 0.2 part water.

The maincharge composition contained 72.9 parts ammonium nitrate, 9.0 parts sodium nitrate, 6.3 parts dinitrotoluene, 1.8 parts anthracite, 10.0 parts aluminum and 0.15 part water.

The bodies were filled with explosive composition and tightly closed with high density polyethylene closure caps having an average thickness of 1.3 mm. The filled charges were immersed in water at 70° C for 20 minutes and cooled in order to harden the explosive contents. The charges were placed under water at a pressure of 30 pounds per square inch for 20 hours after which time the primer explosive charges remained sensitive to initiation by a No. 8 electric blasting detonator and the maincharge explosive charges remained sensitive to initiation by means of a primer explosive charge screwed in end-to-end engagement therewith.

What we claim is:

1. A flexible plastics container for an explosive charge for use under hydrostatic pressure comprising: a body having a closed end wall and at the other end a neck of smaller transverse cross-section than the body, said neck having an open outer end and an inner end joined to the body by at least two shoulder portions, the shoulder portion nearest the neck having a shoulder surface facing generally in the same direction as the open end of the neck and merging with the inner end of the neck and a generally cylindrical surface which merges into a shoulder surface of the adjacent shoulder portion; and a closure cap for sealing the opening at the outer end of said neck, said cap having a circular end wall portion adapted to engage the outer end of said neck transversely to provide a leakproof seal and, depending from said circular end wall portion, a continuous central plug adapted to fit closely into the opening and support the neck against internal distortion and an outer annular skirt adapted to fit around the outside of the neck and to tightly embrace with its lower peripheral edge said generally cylindrical surface to support the neck and adjacent shoulder portion against external distortion, the plug and skirt defining an annular recess adapted to receive the neck, and the closure cap and container body having engagement means to retain the closure cap and body in sealing engagement.

2. A flexible container as in claim 1 wherein the outer annular skirt of the closure cap has a cross-section no greater than the cross-section of the container body.

3. A flexible container as in claim 1 wherein said cap has an internal shoulder surface resting firmly on the shoulder surface which merges with the inner end of the neck.

4. A container as claimed in claim 1 wherein said engagement means includes screw engagement means.

5. A container as claimed in claim 4 comprising locking means to prevent unscrewing of the cap from the container body.

6. A container as claimed in claim 5 wherein the locking means comprises ratchet interengagement means.

7. A container as claimed in claim 1 comprising an annular sealing ring of resilient material in the annular recess of the closure cap.

8. A container as claimed in claim 1 having connecting means for connecting a plurality of such containers in file.

9. A container as claimed in claim 8 having a threaded portion at its closed end and a mating threaded portion on the closure cap whereby the closed end of the container may be screwed to the closure cap of a further similar container.

10. A container as claimed in claim 9 wherein the plug portion of the closure cap has an internally threaded external recess in the circular end wall portion and the closed end of the container body has an externally threaded axially projecting tubular portion.

11. A container as claimed in claim 1 wherein the closure cap includes an internally projecting pocket adapted to accommodate a detonator.

12. A container as claimed in claim 1 fabricated from material selected from the group consisting of polyethylene, polypropylene and polyvinyl chloride.

13. An explosive charge for use under hydrostatic pressure comprising high explosive composition encased in a flexible container as claimed in claim 1.

14. An explosive charge as in claim 13 wherein the outer annular skirt of the closure cap has a cross-section no greater than the cross-section of the container body.

15. An explosive charge as in claim 13 wherein said cap has an internal shoulder surface resting firmly on the shoulder surface which merges with the inner end of the neck.

16. An explosive charge as claimed in claim 13 wherein the high explosive composition is an ammonium nitrate powder explosive.

17. An explosive charge as claimed in claim 16 wherein the high explosive composition comprises ammonium nitrate sensitised with trinitrotoluene or dinitrotoluene.

18. An explosive charge as claimed in claim 16 wherein the ammonium nitrate powder explosive is at least partially hardened.

19. A method of seismic prospecting wherein seismic waves are generated by the firing of an explosive charge as claimed in claim 13.

* * * * *